US005141480A

United States Patent [19]

Lennox et al.

[11] Patent Number: 5,141,480

[45] Date of Patent: Aug. 25, 1992

[54] BENCH PRESS EXERCISE APPARATUS

[76] Inventors: James J. Lennox, 22 Irving Pl.; Joseph A. Wilk, 200 Coal St., both of Wilkes Barre, Pa.

[21] Appl. No.: 530,866

[22] Filed: May 31, 1990

[51] Int. Cl.[5] ..... A63B 21/078

[52] U.S. Cl. ..... 482/104; 482/142; 482/908

[58] Field of Search ..... 272/117, 123, 130, 134, 272/143, DIG. 7

[56] References Cited

U.S. PATENT DOCUMENTS

| | | | |
|---|---|---|---|
| 3,348,893 | 10/1967 | Katzey et al. . | |
| 4,249,726 | 2/1981 | Faust | 272/123 |
| 4,253,662 | 3/1981 | Popolak | 272/144 X |
| 4,411,424 | 10/1983 | Barnett | 272/143 X |
| 4,615,524 | 10/1986 | Sotherland | 272/123 |
| 4,632,390 | 12/1986 | Richey . | |
| 4,757,994 | 7/1988 | Chenvera | 272/144 |
| 4,789,152 | 12/1988 | Guerra | 272/144 |
| 4,807,875 | 2/1989 | Tanski | 272/123 |
| 4,826,157 | 5/1989 | Fitzpatrick | 272/144 X |
| 4,844,453 | 7/1989 | Hestilow | 272/130 X |
| 4,877,239 | 10/1989 | Dela Rosa | 272/134 X |

*Primary Examiner*—Robert Bahr

*Attorney, Agent, or Firm*—Nies, Kurz, Bergert & Tamburro

[57] ABSTRACT

Bench press exercise apparatus comprising a vertical frame having horizontal safety bars and a vertically adjustable bench mounted adjacent the frame. The bench is retained at a normal excerising height, but may be automatically lowered by the person exercising to place the barbell on the safety bars and thereby avoid injury to the person.

16 Claims, 2 Drawing Sheets

BENCH PRESS EXERCISE APPARATUS

BACKGROUND OF THE INVENTION

This invention relates generally to exercise equipment, and more particularly, to a novel exercise apparatus for use during bench press exercising. The novel bench press apparatus of the invention allows a person to complete a bench press exercise in safety without the need of a spotter.

When bench pressing, a person lies on his back on a bench with his feet on the floor and raises and lowers over his chest a barbell which consists of a bar having on its ends balanced changeable weights which may provide a combined weight of several hundred pounds. At the end of the exercise, the person must elevate the barbell one last time to place it on support members or pegs provided on a squat rack or frame extending vertically perpendicularly with respect to the bench.

A person often over-extends himself during the exercise and is unable to raise the barbell a final time to place it on the support pegs. For this reason, the exercise is considered dangerous and it is recommended that it be performed only in the presence of a nearby spotter who may quickly come to the assistance of the person exercising to help him place the barbell on the support pegs. Otherwise, the barbell may settle or fall on the chest of the person and cause serious injury to the person.

While it is prudent for a person to perform the bench press exercise only in the presence of a spotter, persons often become careless and bench press without a spotter and thereby subject themselves to the risk of serious injury. The prior art has recognized this problem and has proposed several safety devices intended to enable a person to perform the bench press exercise in the absence of a spotter. Typical proposals are shown in U.S. Pat. Nos. 4,249,726 and 4,807,875. These units, however, employ rather complex mechanisms for raising and lowering the barbell on the upright vertical frame when necessary, and to applicants' knowledge none of these has become commercially available with bench press equipment.

SUMMARY OF THE INVENTION

Accordingly, the primary object of this invention is to provide novel bench press exercise equipment with which a person may safely exercise without the presence of a spotter.

Still another object of the invention is to provide the above novel equipment comprising a generally horizontal bench and a vertical upright support rack or frame connected to one end of the bench, the frame including horizontal safety supports and the bench being vertically adjustable with respect to the supports so as to enable the exercising person to automatically lower the bench and permit the barbell to come to rest on the safety supports if necessary at the end of an exercise program.

A further object of the invention resides in the provision of the above novel exercise equipment wherein as the bench moves downwardly, it also moves forwardly toward the vertical frame to ensure that the barbell comes to rest on the safety supports.

Another object of the invention resides in the provision of the above novel exercise equipment wherein the bench includes a retainer mechanism by which it is supported in a normally raised exercise position, the retainer mechanism being releasable by the person exercising to automatically lower the bench and cause the barbell to come to rest on the safety supports.

These and other objects will become apparent from reading the following detailed description of the invention wherein reference is made to the accompanying drawings in which like elements are identified by like numerals.

DETAILED DESCRIPTION OF THE INVENTION

Figure 1:
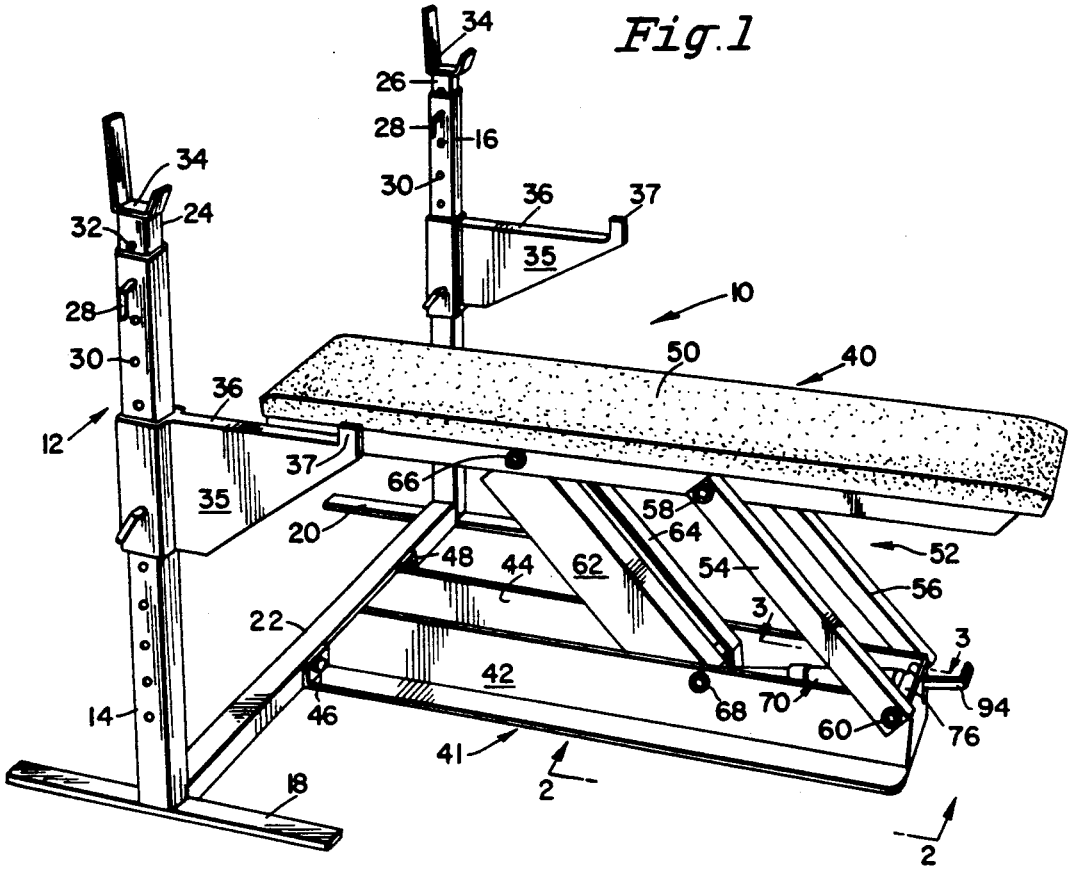
FIG. 1 is a general side perspective view of the bench press exercise apparatus of the invention.
Figure 2:
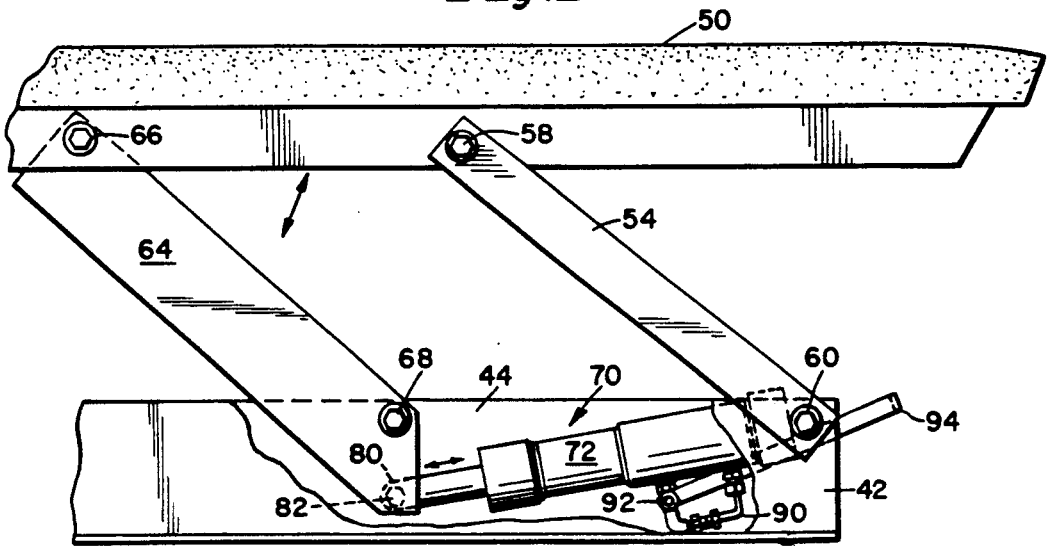
FIG. 2 is a fragmentary elevation view taken generally along line 2—2 of FIG. 1 illustrating the linkage and retainer mechanism by which the bench is raised and lowered with respect to the support rack.

Referring now to FIGS. 1 and 2 of the drawings, the novel bench press apparatus 10 of the invention includes a vertical support rack or frame 12 formed by laterally spaced outer tubular upright posts 14 and 16 having bottom foot rests 18 and 20, the posts being connected together by a transverse bottom tubular member 22. Slidably, telescopically supported within posts 14 and 16 are vertically adjustable inner posts 24 and 26 which, after adjustment, are maintained in a set height position by pins 28 that extend through aligned ones of a plurality of drilled holes 30 and 32 in the outer and inner posts.

A barbell bar support or cradle member 34 is fixed on the top of each post 24 and 26 to normally support the barbell at the start of the bench press exercise.

A safety support bar or arm 35 is vertically adjustably mounted on each of the posts 14 and 16 and is locked in place on the posts by a removable pin 36 extending through aligned drilled holes in the arm and posts. Each arm 35 has a rearwardly extending horizontal support surface 36 terminating in an upstanding projection or lug 37 which prevent the barbell from rolling off surfaces 36 when the barbell is resting thereon.

A bench assembly 40 includes a base frame 41 formed by laterally spaced angle iron members 42 and 44 extending perpendicularly rearwardly from member 22 and fastened to member 22 by bolt assemblies 46 and 48. A bench 50 is vertically adjustably supported above frame members 42 and 44 to lie in a substantially horizontal position by a pivotable linkage mechanism 52 including a pair of rearward link arms 54 and 56 pivotally connected at their upper ends by pin 58 to the underside of bench 50 and at their lower ends on the outside of members 42 and 44 to pin 60 which extends transversely through the links and across members 42 and 44.

Figure 5:
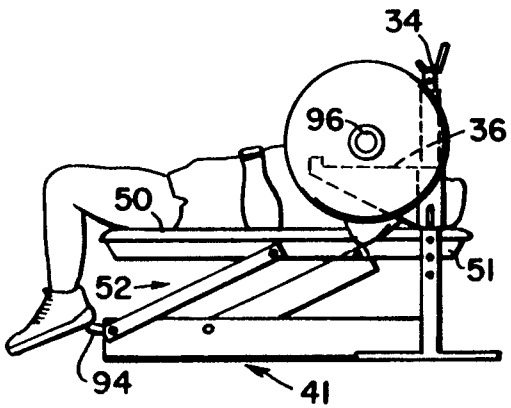
FIG. 5 is a view similar to FIG. 4 but showing a person holding the barbell in a lowered position.
Figure 4:
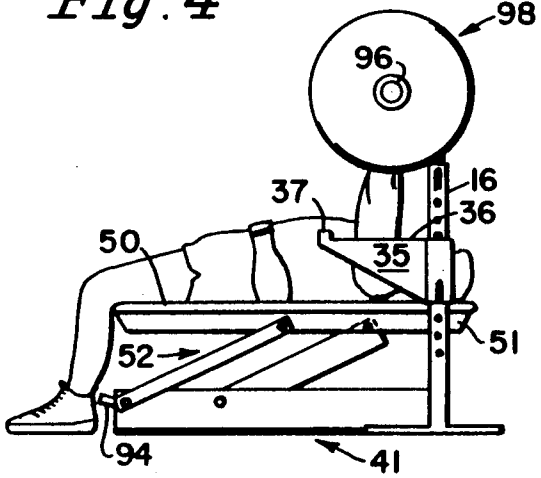
FIG. 4 is a schematic illustration of the exercise equipment with the bench in a raised position supporting a person exercising and holding the barbell in a raised position.

Mechanism 52 also includes a pair of forward link arms 62 and 64 positioned within the space between frame members 42 and 44 and pivotally connected at their upper ends by pin 66 to the underside of bench 50. Links 62 and 6 at their lower ends are pivotally connected to pin 68 which extends laterally between frame members 42 and 44 adjacent their upper edges. As shown generally in FIG. 2, the vertical height of the pivot points 60 and 68 above the bottom of frame members 42 and 44 is the same and the center distance between pivot points 58 and 60 on links 54 and 56 and the center distance between pivot points 66 and 68 on links 62 and 64 are the same. Thus, as bench 50 is raised or lowered to a desired height position, it is maintained in a substantially horizontal position at all times. Also, links 54, 56, 62, and 64 are inclined rearwardly from bench 50 to frame members 42 and 44 so that as bench 50 is lowered it also moves toward frame 12. As seen in FIGS. 1, 4, and 5, the forward end 51 of the bench extends beyond posts 14 and 16 to provide full support for the head of a person engaging in the bench press exercise.

Figure 3:
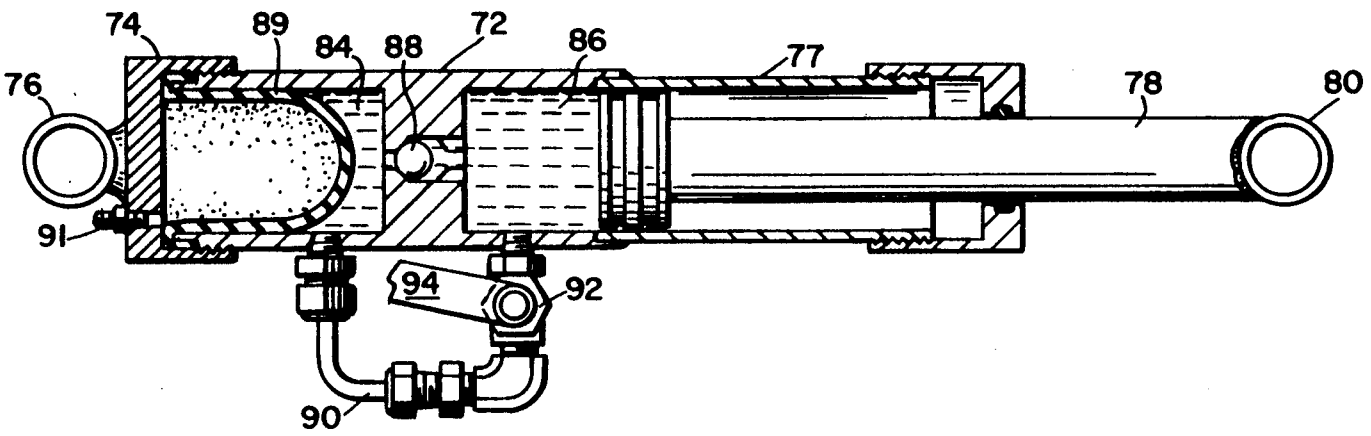
FIG. 3 is a fragmentary sectional view taken generally along line 3—3 of FIG. 1 illustrating a retainer mechanism which may be employed in the invention.
Figure 6:
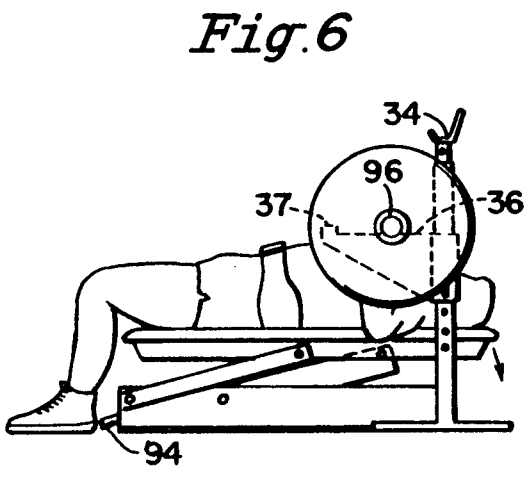
FIG. 6 is a schematic illustration similar to FIGS. 4 and 5, but showing the bench in a lowered safety position whereby the barbell comes to rest on the horizontal safety supports thereby enabling the person to crawl out from under the barbell and avoid any injury to his chest.

A retainer mechanism 70 is mounted within frame members 42 and 44 and may be of any mechanical, pneumatic, hydraulic or electrical type suitable to perform the required function. In the embodiment shown in FIGS. 1, 2 and 3, mechanism 70 is an hydraulic cylinder unit which permits bench 50 to be manually raised at will to a desired height position and retained in that position during the normal exercise program. If necessary, mechanism 70 is releasable to permit a slow, controlled, downward movement of bench 50 at the end of a bench pressing exercise.

Mechanism 70 includes an hydraulic cylinder 72 having a capped end 74 on which a small, cylindrical sleeve 76 is welded, the sleeve 76 being pivotally mounted on pin 60. Cylinder 72 includes a piston 77 and rod 78 having welded on its outer end a sleeve 80 which is pivotally connected to pin 82 extending between links 62 and 64, the pin 82 being located at a location vertically beneath pin 68 so that outward movement of piston rod 78 corresponds to upward movement of bench 50 and inward movement of rod 78 permits the lowering of bench 50. Cylinder 72 includes a rear hydraulic chamber 84 and a forward hydraulic chamber 86 connected by a check valve assembly 88 permitting one-way movement of fluid from chamber 84 to chamber 86. A flexible rubber bladder 89 is mounted in and seals the end of chamber 84 and is connected to the atmosphere by vent 91. Piston rod 78 may be manually pulled outwardly, causing fluid to be transferred from chamber 84 past check valve 88 into chamber 86. However, the rod 78 cannot be pushed inwardly because check valve 88 prevents passage of the hydraulic fluid from chamber 86 back into chamber 84.

A by-pass circuit 90 around check valve assembly 88 connects chambers 84 and 86, with circuit 90 including a normally closed valve 92 which is movable to an open position by a foot operated lever 94 actuated by the foot of the exercising person, if necessary, as shown in FIG. 5.

The apparatus will now be described as it is used by a person performing a bench press exercise. Initially, the various components are adjusted to accommodate the size of the particular person. For example, posts 24 and 26 are adjusted vertically with respect to posts 14 and 16 and then locked in place by pins 28. The height of bench 50 is appropriately set by merely raising the bench manually. The bench can be easily raised because during its upward motion, links 62 and 64 pivot about pin 68 and thus pull rod 78 outward of cylinder 72, with the hydraulic fluid thereby being transferred from chamber 84 past check valve assembly 88 into chamber 86. Once bench 50 has been adjusted to its appropriate height, for example that shown in FIG. 4 of the drawing, it cannot be lowered until the normally closed valve 92 is moved to its open position by actuating lever 94. Next, the safety arms 35 are lowered to a position such that the surfaces 36 are below the bar 96 of barbell 98 when the exercising person has the barbell unit in its lowermost position in normal operation such as that shown in FIG. 5. In this way, the safety surfaces 36 will not interfere with the normal exercising motion. The equipment is now ready for use and the barbell 98 with the appropriate number of weights supported on the ends of the bar 96 is placed in support yokes 34.

As shown in FIGS. 4 and 5, the exercising person lies flat on his back on bench 50 with his feet resting on the floor, removes the barbell from yokes 34 and proceeds to raise and lower the barbell a number of times as desired. In the lowermost position shown in FIG. 5, the bar 96 is clear of the support surfaces 36 of safety arms 35 so that the arms do not interfere with the normal use of the exercise equipment. At the end of the exercise, should the person, due to fatigue, be unable to fully raise the barbell back to its uppermost position and place it again on support cradles 34, the person need only push down on actuating lever 94 with his left foot as shown in FIG. 5 to open valve 92. This permits hydraulic fluid to flow from chamber 86 through by-pass circuit 90 back into chamber 84, thus releasing piston 77 and rod 78 for inward movement within cylinder 72, thereby allowing bench 50 to be automatically lowered under the weight of the person and the barbell. Bar 96 will come to rest on surfaces 36 of safety arms 35 and as bench 50 continues its downward movement, the arms and chest of the person are relieved of any pressure of the bar and sufficient clearance is provided so that the person may crawl out from under the bar without suffering any injury.

It should also be noted that because of the construction of link mechanism 52 and the forward arcuate movement imparted to bench 50 as it is lowered, barbell 98 is moved in a direction toward posts 14 and 16 to ensure that the barbell comes to rest on surfaces 36 behind stops 37 so that the barbell cannot inadvertently roll off safety arms 35 onto the body of the exercising person.

To reset the exercise equipment for the next person, it is necessary only to pull lever 94 upwardly, closing valve 92, and then again pull bench 50 upwardly to its desired vertical position with respect to cradles 34 and support surfaces 36. Various modifications and additions may be made to the equipment as desired. For example, an automatic stop may be provided to bring bench 50 to the same preset height adjustment for a particular person to accommodate the size of that particular person. Similarly, while a special hydraulic cylinder retainer and release mechanism 72 has been illustrated, other types may be employed so long as they function to normally retain or lock the bench in a desired raised exercise position and then enable the bench to be released automatically by the exercising person to lower the bench to a safe position and prevent injury to the exercising person.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. Exercise apparatus comprising vertical frame means having generally horizontal bar support means mounted thereon, generally horizontal bench means mounted adjacent said frame means for supporting a person performing a bench press exercise with a barbell, said bench means being vertically adjustable with respect to said frame means, retainer means for holding said bench means in a normal exercise position in which the person may raise and lower the barbell, releasing means for releasing said retainer means to lower said bench means and cause the barbell to be placed on said bar support means, said releasing means spaced a sufficient distance from said horizontal bar support means such that a person holding the barbell with both hands may operate said releasing means while retaining the barbell with both hands and without using his or her hands, thereby freeing the barbell from the person.

2. Apparatus according to claim 1 comprising pivotable support linkage means for raising and lowering said bench means.

3. Apparatus according to claim 2, said linkage means being constructed so as to move said bench means toward said frame means as said bench means is lowered.

4. Apparatus according to claim 3, said retainer means being connected to said linkage means to hold said linkage means and thereby said bench means in a normal exercise position.

5. Apparatus according to claim 2, said retainer means being connected to said linkage means to hold said linkage means and thereby said bench means in a normal exercise position.

6. Apparatus according to claim 1, comprising horizontal base means connected to and extending rearwardly from said vertical frame means, pivotable linkage means supporting said bench means from said base means, said linkage means permitting said bench means to be raised and lowered.

7. Apparatus according to claim 6, said linkage means being constructed so as to move said bench means toward said frame means as said bench means is lowered.

8. Apparatus according to claim 7, said retainer means being connected to said linkage means to hold said linkage means and thereby said bench means in a normal exercise position.

9. Apparatus according to claim 8, said releasing means being a foot operated lever.

10. Apparatus according to claim 1, said retainer means being an hydraulic cylinder.

11. Apparatus according to claim 1, said releasing means being a foot operated lever.

12. Apparatus according to claim 1, comprising cradle means mounted on said frame means in vertically spaced relationship above said horizontal bar support means, said cradle means normally supporting the barbell.

13. Apparatus according to claim 12, comprising pivotable support linkage means for raising and lowering said bench means, said linkage means being constructed so as to move said bench means toward said frame means as said bench means is lowered.

14. Apparatus according to claim 13, said retainer means being connected to said linkage means to hold said linkage means and thereby said bench means in a normal exercise position.

15. Apparatus according to claim 12, said releasing means being a foot operated lever.

16. Exercise apparatus comprising vertical frame means having generally horizontal bar support means mounted thereon, generally horizontal bench means mounted adjacent said frame means for supporting a person performing a bench press exercise with a barbell, said bench means being vertically adjustable with respect to said frame means, retainer means for holding said bench means in a normal exercise position in which the person may raise and lower the barbell, means including a foot operated lever operable by the person while holding the barbell for releasing said retainer means to lower said bench means and cause the barbell to be placed on said bar support means, thereby freeing the barbell from the person.

* * * * *